United States Patent [19]

Lindquist

[11] Patent Number: 4,574,526

[45] Date of Patent: Mar. 11, 1986

[54] SLIDING CLOSURE

[76] Inventor: Edwin A. Lindquist, 525 "S" St., P.O. Box 957, Sacramento, Calif. 95804

[21] Appl. No.: 579,124

[22] Filed: Feb. 10, 1984

[51] Int. Cl.[4] ..... E05D 13/00

[52] U.S. Cl. ..... 49/411; 16/87 R

[58] Field of Search ..... 49/411, 410, 409, 412, 49/413; 16/87 R, 87 B, 97, 105

[56] References Cited

U.S. PATENT DOCUMENTS

| | | | |
|---|---|---|---|
| 246,286 | 8/1881 | Brinton | 49/410 X |
| 865,046 | 9/1907 | Kail | 49/409 X |
| 1,610,282 | 12/1926 | Hansen | 49/410 |
| 1,775,827 | 9/1930 | Pacyna et al. | 49/409 X |
| 2,784,445 | 3/1957 | Greig et al. | 49/410 X |
| 2,980,969 | 4/1961 | Tin Fow | 49/411 |
| 3,653,157 | 4/1972 | Casebolt | 49/411 |
| 3,696,560 | 10/1972 | Hallin | 49/409 X |
| 3,852,916 | 12/1974 | Laby | 49/409 |
| 3,896,508 | 7/1975 | Doan | 49/409 X |
| 4,042,004 | 8/1977 | Kwan | 49/413 X |
| 4,090,265 | 5/1978 | Baus | 49/409 X |
| 4,148,535 | 4/1979 | Fenwick | 49/410 X |
| 4,152,870 | 5/1979 | Knap | 49/409 X |
| 4,178,718 | 12/1979 | Laby | 49/411 |
| 4,388,778 | 6/1983 | Brooke | 49/411 X |

*Primary Examiner*—Philip C. Kannan
*Attorney, Agent, or Firm*—Leonard Bloom

[57] ABSTRACT

A sliding door construction which includes trim disposed on side edges of the door and the trim on the side edges having an upwardly extending tab provided with a diagonal slot at its uppermost extremity having a roller carried therein adapted to move along the length of the diagonal slot, the roller constrained to ride in an overhead trackway and freely move along the diagonal slot to provide and accommodate variations in dimension between upper and lower frame members. Various channel members are disposed at a lowermost horizontal extremity to accommodate different types of design considerations.

3 Claims, 5 Drawing Figures

FIG 1
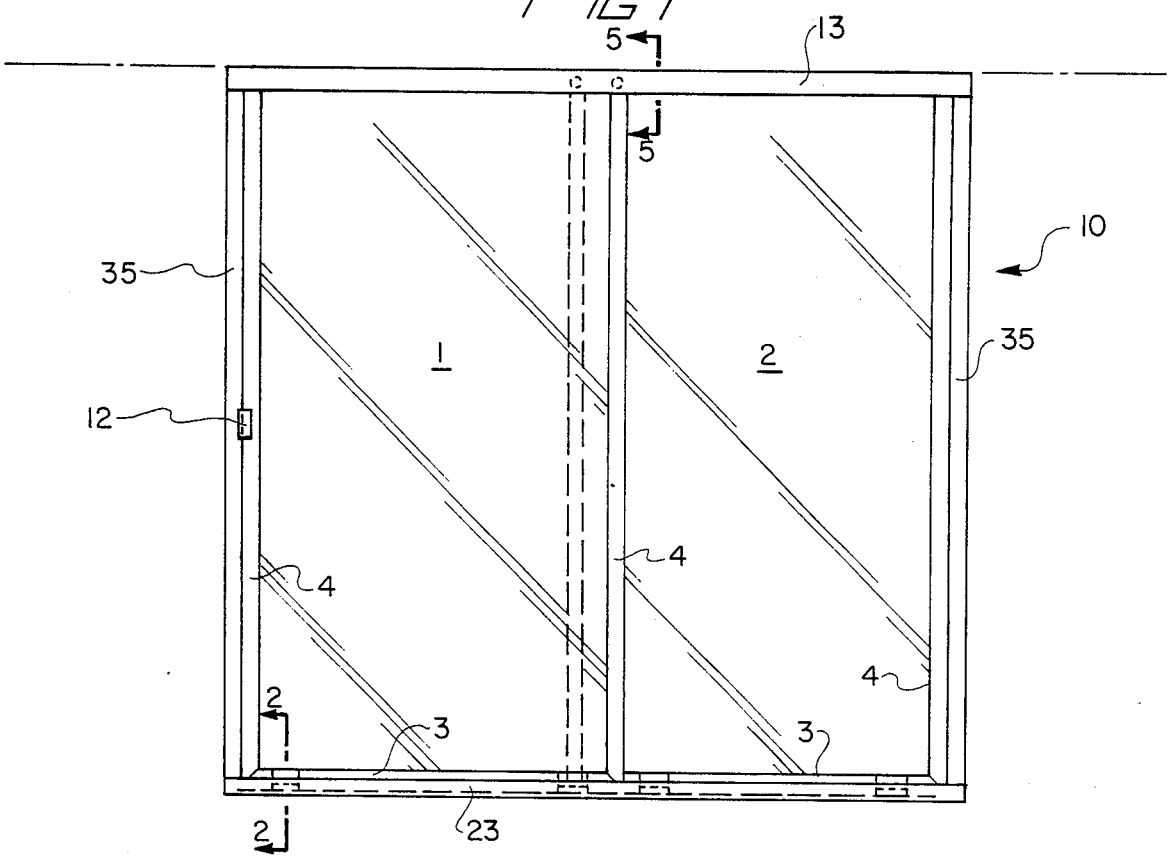
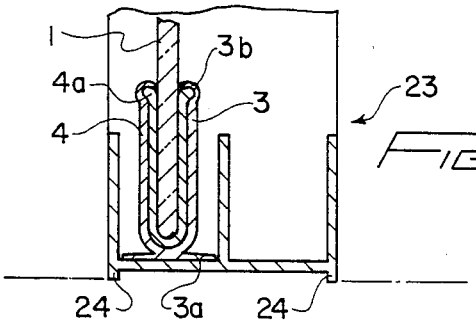
FIG 2
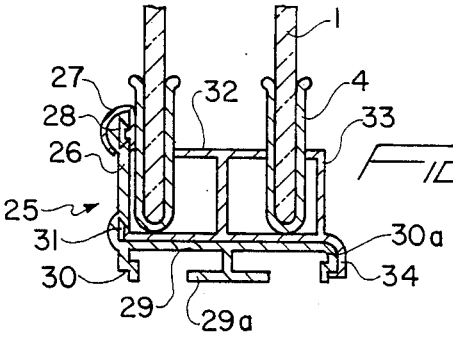
FIG 3
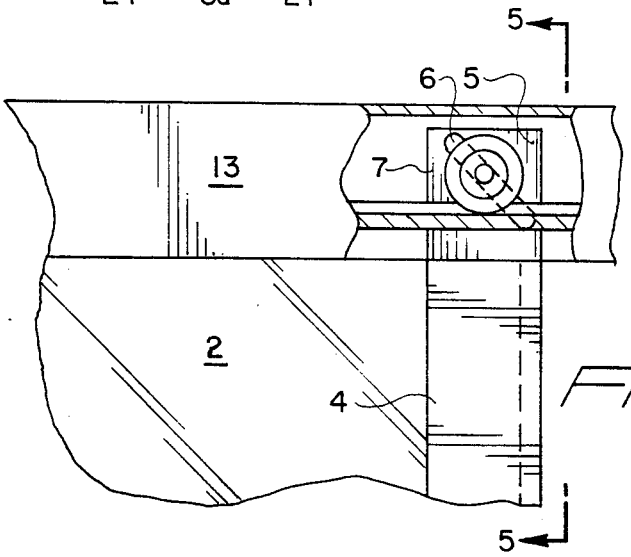
FIG 4
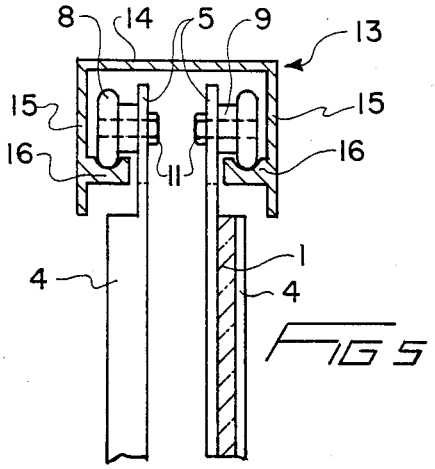
FIG 5

SLIDING CLOSURE

BACKGROUND OF THE INVENTION

The following invention relates generally to sliding doors. More particularly, an associated frame which circumscribes the door and defines the portal within which the door is slidably disposed includes trim disposed on side and bottom edges of the sliding door adapted to register with associated frame components fastened to the portal so that when the door and/or doors are in abutting engagement with the frame members a tight seal is afforded. The top edge of the door is devoid of a trim member and accordingly upstanding tabs of the side edge trim cooperate with an upper horizontal frame member so that the door is hung in depending relationship from the upper frame member. Variations in dimension of the portal and therefor the frame member's relationship to the door is afforded by a suspension mechanism extending between the upper horizontal frame and the associated side trim to accommodate foundation settling, lack of trueness in rectangular relationship of the frame to the door, warping, bowing and other tendencies which cause doors of this type to jam.

The provision of sliding doors has brought with it a concomitant problem of assuring adequate clearance between the frame circumscribing the door and the door to obviate any binding or similar type of obstruction which interferes with the opening and closing process of the door or window. While lack of trueness in dimensioning the portal to the door or the associated frame may exist at the time of building fabrication, misalignment and dimensional change can occur seasonally or with fatigue in the structural components associated with the portal. Installation problems also exist in new construction to accommodate lack of dimensional trueness when fitting a sliding panel into its associated portal.

The following patents represent the state of the art of which applicant is aware, insofar as these patents are germane to the process at hand:

| | | |
|---|---|---|
| 246,286 | Brinton | Aug. 30, 1881 |
| 805,846 | Kail | Sept. 3, 1907 |
| 2,784,445 | Greig et al | Mar. 12, 1957 |
| 3,696,560 | Hallin | Oct. 10, 1972 |
| 3,852,916 | Laby | Dec. 10, 1974 |
| 3,896,508 | Doan | July 29, 1975 |
| 4,090,265 | Baus | May 23, 1978 |
| 4,152,870 | Knap | May 8, 1979 |

The patent to Greig et. al. is of significance since they teach the use of a sliding door in which a channel shaped hanger is adapted to engage a side edge of a sliding door. The hanger includes a sidewall 46 (FIG. 6) that has an upwardly extending portion which supports a roller 50 journaled upon a pin 52. The channel shaped hanger is suitably formed so as to allow adjustment from one horizontal plane to another by means of a leaf 60 which cooperates with serrations 67, which when once adjusted, is affixed thereto by means of a screw 68 causing the leaf to engage the serrations. Thus, once adjusted, the roller maintains a fixed position.

Hallin teaches another known prior art technique for an adjustable panel alignment apparatus which as shown in FIGS. 7–11 include a support trackway from which depends the framed panel 50. The framed panel is provided with an adjustment to offset any out of square frames within which the panel may be disposed and includes a control bar 64 provided with two oppositely disposed and inclined slots 66, the center points of which are respectively coincident with vertical slots 58. Axles 60 are therefor engaged not only in the inclined slots 66, but also the vertical slots 58. The panel is aligned with the frame 52 by means of a thumbscrew 68 which is rotated to move the control bar 64 relatively horizontally with respect to a stem 54. The axles 60 carrying rollers 62 engage in both of the slots 58 and 66 to remain horizontally spaced in the vertical slots 58 but with their centers shifted vertically in opposite directions in slots 66 to thereby tilt the panel.

Laby teaches the use of a sliding glass panel held only by two side rails removeably and adjustably mounted on a track. A spring clip 28 is adapted to alter the elevation of a roller 78 which is supported on a hanger 26, the hanger provided with notches 82 which are adapted to register with the spring clip 28 in fixed relationship with the side rails 22 (FIG. 2).

Kail teaches the use of a depending moveable door adapted to ride on rollers in which the lowermost portion of members 21 and 22 depend from the roller and has an arcuate slot 27, 28 which allows angulation of the panel 30 by it typical connection to the slot through members 25 and 26.

Brinton provides a door hanger in which at least one of the rollers which support a sliding door in depending relationship is attached to a side edge thereof.

The remaining citations show the state of the art further.

The instant invention is distinguished over the known prior art in that the sliding doors which are supported in depending relationship from an upper horizontal frame member are supported solely by side trim pieces affixed to the doors, the trim pieces including an upwardly extending tabs having a diagonally disposed slot provided with a roller supported on an axle which passes through the slot, the axle is capable of free motion within the slot itself. The rollers are adapted to ride within trackways carried in the upper frame and therefor prevent binding of the panel by its plural such roller supports since the tendency of any portion of the panel being out of registry with the frame and causing binding is offset by the roller axle's translation along the diagonal slot. The force of gravity tends to maintain the panel or sliding door in such a manner that the top and bottom edges remain in a horizontal plane so that the bottom edge's registry with an associated underlying channel way is not in any way compromised thus sealing, guiding or constraining the panel can occur out of channel can proceed effectively without having portions of the door ride up above the channelway. The mode of installation of the instant application distinguishes itself further over the known prior art since a minimal attention to the dimensional errors can be afforded the person doing the installation. Thus, a somewhat lower skill level is required than would be required in the prior art, and in addition, once the installation has been completed, shifting in the foundation of the building or distortion of the structure's supporting members which would cause the portal associated with the sliding door to become out of square will not have a deleterious effect on the sliding door.

Thus, not only does the structure according to the instant invention provide a lesser degree of criticality in alignment of the various components, it can also accommodate changes to the relationship of the portal to the sliding door as a function of time. Moreover, it is noteworthy that the structure is relatively simple in its components and does not require specialized tools for the installation thereof.

The vertical side channel containing the roller will permit the door panel to be moved up to three-fourths of inch from the channel edge as an accommodation to an out-of-plumb wall.

OBJECTS AND SUMMARY OF THE INVENTION

Accordingly, this invention has as its objective the provision of an improved sliding door and its associated support with a peripheral frame member carried in an associated portal.

A further object of this invention contemplates providing a device as characterized above which accommodates dimensional variations in trueness in the relationship of the door to its associated frame, and the frame to its associated portal.

A further object of this invention contemplates providing a device as characterized above in which the frame member is preferably formed from extruded aluminum which upon initialization benefits from mass production techniques and is extremely durable in construction.

A further object of this invention contemplates providing a device as characterized above which can accommodate the change in dimensional relationship of a portal as a function of time.

A further object of this invention contemplates providing a device as characterized above in which the tendency of the sliding door is to be maintained in such a manner that the top edge thereof is disposed in a horizontal plane.

A further object of this invention contemplates providing a device as characterized above which when used as a shower door for example discourages the migration of water beyond the door which serves as a barrier, and for this purpose a channel arrangement is provided which precludes the migration of water therebeyond.

A further object of this invention contemplates providing a device as characterized above which is noncumbersome and aesthetically pleasing so that it can be used in various types of environments and decor without detracting from the associated ambiance.

A further object of this invention is the elimination of the horizontal framing of the door, the incorporation of the roller on a side vertical framing of the door with up to one inch adjustability of the door panel itself within the side framing to afford the installer an ability to easily accommodate out-of-plumb walls while not reducing ease of opening or closing of the door panel nor reducing visual aesthetics.

These and other objects will be made manifest when considering the following detailed specification when taken in conjunction with the appended drawing figures.

BRIEF DESCRIPTION OF THE DRAWINGS

FIG. 1 is a side elevational view of the sliding door according to the instant application.

FIG. 2 is a sectional view taken along lines 2—2 of FIG. 1.

FIG. 3 is a view similar to FIG. 2 showing an alternative embodiment thereof.

FIG. 4 is an enlarged view of an upper central portion of FIG. 1.

FIG. 5 is a sectional view taken along lines 5—5 of either FIG. 1 or FIG. 4.

DESCRIPTION OF THE PREFERRED EMBODIMENT

Referring to the drawings now, wherein like numbered parts refer to like numbered parts throughout the various drawing figures, reference numeral 10 is directed to the moveable panel assembly according to the present invention.

In general, the panel assembly includes first and second sliding doors, 1 and 2 respectively, disposed in a frame. More particularly, each door includes a rectangular blank having top, bottom and side edges. The side edges are provided with vertical trim pieces, and the bottom edge includes a similarly formed trim piece, but the top edge is devoid of any trim in a preferred form of the embodiment.

A lower horizontal channel 23 serves to support each door as it translates along a longitudinal aspect of the channel 23 and has a plurality of embodiments which will be delineated hereinafter. Terminal portions of the channel 23 communicate with upwardly extending vertical frames 35 whose topmost extremities interconnect by means of an upper horizontal frame 13. Thus, the frame associated with the first and second doors allow the doors to be moved between opened and closed positions and not only serve as supports for the doors, but also serve as a guideway and areas of nesting between the doors and the frame to retard the migration of moisture and/or temperature loss from one side of the door to another.

The vertical door trim pieces 4 are shown in the drawings as being of substantially U-shaped configuration, said trim pieces are received within the lower horizontal frame and includes outwardly splayed edges 4*a* adapted to frictionally overlie the edge and an adjacent edge portion of the door 1 or 2 and be tightly received therein. FIGS. 4 and 5 show how the vertical trim pieces communicate with the upper horizontal frame. More particularly, each U-shaped vertical trim piece 4 includes one leg extending upwardly to define a door support tab 5 which passes beyond the top edge of the door. The tab 5 includes a diagonal slot 6 adapted to receive therewithin a roller support axle 7 passing therethrough carrying at one end thereof a support roller 8, the support roller 8 being separated from the tab by an interposed bushing 9 carried on the axle, the axle 7 in turn connected to the tab 5 by means of an axle nut 11 shown in FIG. 5. Thus, the door 1 is adapted to be supported in depending relationship solely by means of the support roller 8 and its connection with the tab 5 emanating up from the vertical trim piece 4.

The upper horizontal frame 13 carries each roller 8 in the following manner. The upper horizontal frame 13 includes a top wall 14 having downwardly extending sidewalls 15 which serve to support inwardly directed tracks 16 having a curved roller support dimensioned to receive the support roller 8 thereon. The sidewalls 15 include skirt portions extending below the track 16 as shown in FIG. 5 to preclude migration of water and the like up within the roller assembly and above the top edge of the door 1. The roller support track 16 includes an inwardly extending leg having an arcuate top surface along the longitudinal extent of the upper horizontal frame 13 which is substantially U-shaped in section as shown. Thus, with the roller 8 supported on the curved surface of the track 16, the roller 8 and its cooperation with the diagonal slot 6 allows the roller axle 7 to migrate along the diagonal slot to accommodate and provide a suspension mechanism for the doors 1 and 2 in such a manner that the relationship of the axle 7 to the slot can change as the door moves from a first to a second position without binding occurring in the sliding movement of the door (within the dimensional limitations of the diagonal slot). This is an important aspect in the instant invention since the relationship of the upper and lower horizontal frames may dimensionally vary either upon initial construction or as foundation settling, joist bowing or structural warping, etc. may cause the dimensions between the two frames to change as a function of time.

FIG. 2 provides a detail of the lower horizontal channel 23 which as shown is E-shaped in section and allows a bottom edge of the door 1 or 2 to be placed within one of the two channels defined by the E-shaped section. Clearly, the vertical frames 35 may have a similar configuration. As shown in FIG. 2, the lower horizontal channel 23 includes support feet 24 to space the channel from an associated supporting surface as shown in the drawings. When the device is to be used as a shower door, drainage holes may be provided in the horizontal channel 23 to allow migration of water collected within the channel to be returned back within the tub enclosure for associated benefits. As shown in FIG. 2, the bottom edge of the door 1 includes a horizontal door trim piece 4 having the same configuration as the door vertical trim pieces and includes the outwardly splayed edge 4*a*, the trim piece 4 allowing a lower horizontal door channel guide 3 to be snap fitted thereover to serve as a guide in constraining the door 1 to travel along the channel defined by the E-shaped lower horizontal channel 23 as shown. More particularly, the channel guide 3 includes a base 3*a* dimensioned to be received within each trackway of the channel and an upwardly extending U-shaped clip adapted to overlie the trim piece and includes a rolled lip 3*b* adapted to resiliently overlie the splayed edge 4*a* of the trim piece. The interface between the channel 23 and the guide base 3*a* may include friction reducing properties such as a teflon interface, or magnets of opposite polarity so that the door "floats" by magnetic repulsion within the channel.

The lower horizontal channel can have a further form and is shown in FIG. 3, a second embodiment includes the following horizontal channel 25:

A vertically disposed innerwall 26 (in relationship to a tub enclosure for example) supports a top edge thereof a seal 27 having an arcuate outer face adapted to overlie a protrusion or bead on a top outer edge of the vertical innerwall 26, the seal 27 has a dovetailed shaped strip 28 adapted to be frictionally received within an associated dovetailed shaped groove on the vertical wall adjacent the bead on an innerface thereof to support the seal thereon. A lowermost portion of the inner vertical wall 26 includes a second bead that allows communication with an I-shaped support base having a topmost portion of greater transverse extent than its associated I-shaped base support foot 29*a*. In addition, extremities of an upper horizontal base 29 include downwardly depending stepped feet 30 adapted to sit upon an associated ridge on the object of support which in turn supports the channel 25. As shown in the drawings, the stepped foot 30*a* which is remote from the inner vertical wall 26 includes a curved wall associated therewith at the transition area from the horizontal base 29 to the foot 30*a*. Base 29 is adapted to receive thereover an H-shaped channel in section 32 which includes at the area of the curved wall 30*a*, a snap strip 34 complementally formed to overlie and resiliently affix to the curved wall 30*a*, while another opposed base support portion fits into a recess 31 formed at a bottom portion of the vertical wall 26 and the base 29. As shown in FIG. 3, the H-shaped channel includes a vertical wall and an inwardly directed lip 33 integrally formed therewith on a side of the channel remote from the inner vertical wall 26.

In use and operation, the topmost edge of the door 1 or 2 is inserted within the channel of the upper frame 13 and the roller 8 for each door is allowed to reside upon its respective trackway 16. Adequate clearance is provided within the frame 13 to allow the bottom edge of the door to be placed within either of the channels shown in FIGS. 2 or 3, and it should be apparent that by virtue of the diagonal slot 6, bowing or other dimensional variations between the top frame and the bottom frame can be compensated by the dimension of the diagonal slot 6. It is contemplated that the door depend and is supported exclusively by the roller 8 but as shown in FIG. 2 for example, the base 3*a* may assume a portion of the support should the variation in the dimension between the upper and lower frame be substantial. To facilitate the positioning of each door from a first to a second position, a door handle 12 is provided which is of substantially U-shaped configuration and corresponds closely to the configuration of the trim piece 4 including an outwardly splayed section 4*a* adapted to overlie the trim shown in the drawings, the splayed portion for the handle having greater divergency to provide a purchase area for the user.

Having thus described the preferred embodiment of the invention, it should be understood that numerous structural modifications and adaptations may be resorted to without departing from the spirit of the invention.

What is claimed is:

1. In a sliding shower door assembly having two laterally movable panels of substantially planar rectangular configuration, having at least two vertically oriented trim pieces disposed on opposite ends of the said panels, each trim piece having a portion extending upwardly beyond the top edge of said panel, said assembly further having a frame means for supporting said sliding panels thereon and including substantially parallel vertical frame members, an upper horizontal frame member secured between said vertical frame membera, the upper frame member having a top wall and further having downwardly extending sidewalls, the sidewalls having inwardly directed ledges provided with substantially curved recesses formed therein, whereby an upper track is defined, said frame means further having a lower horizontal frame member secured between said vertical frame members, the lower frame member having a bottom wall, upwardly extending sidewalls and an upwardly extending middle wall, whereby lower horizontal channels are defined, the improvement wherein the upwardly extending portion of each trim piece has a diagonal closed cam slot formed therein, a shaft extending transversely through the cam slot and adapted for limited sliding movement therein, and an antifriction roller carried on an end of the shaft and disposed within the upper track, thereby accommodating any misalignment, bowing or warping in the shower door assembly.

2. The sliding door assembly of claim 1, wherein the lower horizontal frame member is provided with support feet, each of the said panels being provided with a horizontal trim piece having outwardly splayed edges, said trim piece being positioned on the lower horizontal edge of each said panel, and wherein said assembly is further comprised of a lower horizontal guide means positioned over said horizontal trim piece, said guide means having a base received within the lower horizontal channel, whereby said panels are further supported and guided within the said lower horizontal channels.

3. The sliding door assembly of claim 1, wherein the lower horizontal frame member comprises a central H-shaped channel having first and second ends, an upwardly extending inner sidewall at the first end, the sidewall including a first tongue and a seal means positioned at the top edge of the sidewall, the sidewall further including a second tongue positioned at the bottom edge thereof, said H-shaped channel further having at its second end an upwardly extending endwall including a downwardly extending curved snap strip at the bottom edge of the endwall and an inwardly directed lip positioned at the top edge thereof, the channel further incuding a top portion having a pair of elongated recesses formed therein constituting first and second elongated recesses, wherein one of the panels is adapted to be received in the first recess and wherein the other side panel is adapted to be received in the second recess, said lower horizontal frame member further comprising a substantially I-shaped support base positioned underlying the said H-shaped channel, said I-shaped support base having a first and second ends, an upwardly extending front wall at the first end being provided with a bead and a first groove at the top edge of the front wall and being further provided with a foot and a second groove at the bottom edge thereof, said first groove being adapted to receive the first tongue of the said inner wall, the second groove being adapted to receive the second tongue of the said inner wall and said bead being adapted to receive the seal of said inner wall, whereby the H-shaped channel is secured at the one end to the I-shaped support base, said I-shaped support base further having at its second end a curved foot adapted be received within the curved snap strip of the said endwall, whereby the H-shaped channel is secured at the second end to the I-shaped support base, and whereby the said panels are further supported and guided within the lower horizontal channel.

* * * * *